United States Patent [19]

Tuggle et al.

[11] 4,378,644

[45] Apr. 5, 1983

[54] POWERED SNOW REMOVAL APPARATUS

[75] Inventors: Lloyd H. Tuggle, Shreveport; Ronald C. Loyd, Keithville, both of La.; Stanley A. Johnson, Jr., Brookfield, Wis.; A. Gary Patridge, Shreveport, La.; John W. Ingham, Shreveport, La.; Kenneth J. Friend, Shreveport, La.

[73] Assignee: Emerson Electric Co., St. Louis, Mo.

[21] Appl. No.: 233,994

[22] Filed: Feb. 12, 1981

[51] Int. Cl.[3] ..... E01H 5/00

[52] U.S. Cl. ..... 37/244; 37/260

[58] Field of Search ..... 37/43 R, 43 A, 43 B, 37/43 C, 43 D, 43 E, 43 F, 43 K, 43 L, 53, 40

[56] References Cited

U.S. PATENT DOCUMENTS

| | | | |
|---|---|---|---|
| 2,023,608 | 12/1935 | Nebel | 37/43 D |
| 2,714,772 | 8/1955 | Erickson | 37/43 C |
| 3,074,189 | 1/1963 | Phelps | 37/43 R |
| 3,199,235 | 8/1965 | Stacey | 37/43 R |
| 3,200,519 | 8/1965 | Kennedy | 37/43 R |
| 3,359,661 | 12/1967 | Speiser et al. | 37/53 X |
| 3,429,060 | 2/1969 | Merry | 37/43 C |
| 3,452,460 | 7/1969 | Cope et al. | 37/43 D |
| 3,673,715 | 7/1972 | Lines | 37/43 L |
| 3,690,047 | 9/1972 | Thoen et al. | 37/43 L |
| 3,774,322 | 11/1973 | Enters et al. | 37/43 R |
| 4,138,829 | 2/1979 | Chase | 37/43 D |
| 4,138,831 | 2/1979 | Chase | 37/43 D |
| 4,294,027 | 10/1981 | Edwards | 37/43 D |

FOREIGN PATENT DOCUMENTS

| | | | |
|---|---|---|---|
| 734662 | 5/1966 | Canada | 37/43 B |
| 123618 | 12/1948 | Sweden | 37/43 D |

OTHER PUBLICATIONS

Roto-Tiller, "Heartsaver", Snow Shovel Attachment Brochure, 4 pp., Dec. 12, 1957, (illustrated order form).

*Primary Examiner*—E. H. Eickholt

*Attorney, Agent, or Firm*—Hubbard, Thurman, Turner & Tucker

[57] ABSTRACT

A hand carriable powered snow removal apparatus having an internal combustion engine power unit removably connected to one end of a tubular boom which supports an elongated drive shaft connected to the engine power takeoff shaft at and to a right angle drive gear unit mounted at the opposite end of the boom. The gear unit includes a housing mounted on the end of the boom and providing a centered drive arrangement for a pair of opposed paddle type impellers mounted on respective ends of an output shaft projecting from opposite sides of the gear housing. A shroud mounted on the gear housing includes an upwardly projecting rear wall and spaced apart lateral side walls partially enclosing the impellers and providing directional control for the snow being discharged from the impellers. A set of movable guide vanes is mounted on the forward end of the shroud and is adjustable to provide for varying the directional attitude of snow being discharged from the shroud. The interior of the rear wall forms a substantially continuous smooth surface which reduces the tendency for snow to accumulate and clog the normal flow path of the snow being discharged by the impellers. A removable scraper bar is mounted on the lower edge of the shroud and also serves as a skid for the apparatus while it is in operation. A handle on the power unit and an adjustable handle on the tubular boom provide for handling and maneuvering the apparatus.

38 Claims, 9 Drawing Figures

POWERED SNOW REMOVAL APPARATUS

BACKGROUND OF THE INVENTION

1. Field of the Invention

This invention pertains to a portable hand carried power operated snow removal apparatus having impellers partially enclosed by a shroud mounted at one end of an elongated support and a prime mover mounted at the opposite end of the support.

2. Background Art

In the art of snow removal equipment there have been numerous inventions pertaining to power operated snow throwers which are mounted on skids or wheels and which may be pushed along the surface to be cleaned free of snow and ice. Known types of snow removal equipment have several disadvantages including physical size and weight which makes the equipment difficult to maneuver, and requires that the equipment, in some instances, be either self propelled or connected to a powered vehicle. Generally, most known equipment is difficult for one person to operate and is too heavy to be used to clean elevated surfaces such as steps or porches.

Accordingly, there has been for some time a substantial need for portable power operated snow removal apparatus which is lightweight and easily hand carried, and is balanced for ease in maneuvering during operation and when being carried to and from the work area. Moreover, there has also been a long felt need for apparatus particularly adapted for cleaning snow and ice from irregular and elevated surfaces such as steps, ramps, porches and surfaces having relatively steep grades which are not easily cleaned by equipment which must be substantially supported by the surface to be cleaned.

There has also been a need for powered snow removal apparatus having impeller mechanism and associated snow discharge directional control housings and the like which resist clogging with snow and ice in operation.

There has further been a need for portable power operated snow removal equipment which may be easily handled in operation as well as in transport to and from the work area and which does not suffer from the disadvantages of electric motor driven equipment.

To a large extent many disadvantages of prior art snow removal equipment have been overcome with the apparatus of the present invention, which apparatus also provides new features heretofore unappreciated for powered snow removal equipment.

SUMMARY OF THE INVENTION

The present invention provides for an improved power operated snow removal apparatus which is lightweight, maneuverable and more easily handled in operation and in transport to and from the work site than previously known types of equipment. In accordance with one aspect of the present invention there is provided a substantially hand held power operated snow removal apparatus characterized by a lightweight internal combustion engine prime mover mounted at one end of an elongated support boom and having snow removal impeller means mounted at the opposite end of the support boom and partially enclosed by a superior snow discharge directional control housing or shroud. The arrangement of a prime mover unit including its own carrying handle and mounted at one end of an elongated support boom together with an adjustable intermediate handle mounted on the boom provides for particularly superior maneuverability of the apparatus and ease of operation in removing snow from relatively large horizontal surfaces such as driveways, patios, and sidewalks. Moreover, the improved apparatus of the present invention is particularly advantageous for removing snow and ice from steps, outdoor stairways and porches as well as sloping surfaces which are not easily cleaned by wheel or skid mounted equipment.

The present invention further provides for an improved, hand carriable, power operated snow removal apparatus having an improved drive mechanism which is compact, mechanically uncomplicated and contributes to the balance and ease of operation of the unit. The apparatus of the present invention includes a drive mechanism comprising an elongated drive shaft mounted within a tubular support boom and connected to a right angle gear drive unit mounted at one end of the boom and having an output shaft having opposed end portions projecting from opposite sides of the gear unit housing. The gear housing is substantially centrally mounted with respect to the longitudinal centerline of the apparatus, including the support boom, provides a mechanically simple and compact drive unit and improves the balance of the snow removal apparatus. The center drive arrangement also provides for substantially eliminating any unbalanced reaction forces imposed on the apparatus by the snow removal impeller means. An important aspect of the present invention is provided by the output shaft of the gear drive unit being of a single diameter which provides for simple and inexpensive manufacturing of the shaft and facilitates assembly and disassembly of the gear drive unit.

Another important aspect of the present invention resides in an improved snow removal apparatus having paddle type impellers which are rugged, resistant to clogging, and are arranged to minimize vibration and reaction forces caused by engagement of the impellers with relatively dense or compacted snow and ice. The improved impeller arrangement of the present invention is characterized by two spaced apart multi-bladed paddle type impellers each being mounted on an output shaft so that the blades of the respective impellers are in staggered relationship about the axis of rotation of the shaft to improve the total snow displacement of the impellers with respect to the power output characteristics of the prime mover. The staggered multibladed impellers are highly efficient and also reduce vibration and unbalanced reaction forces on the snow removal apparatus. The configuration of the impeller paddle blades also reduces the tendency for accumulation of snow and ice around the center drive gear housing.

In accordance with a further advantageous aspect of the present invention snow impeller paddles are provided which are made of a lightweight high strength plastic and are adapted for use with an improved drive connection arrangement between the paddles and the drive shaft, which drive connection provides for improved distribution of driving forces imposed on the paddles by the shaft.

In accordance with yet another aspect of the present invention there is provided a snow removal apparatus having an improved housing or shroud forming a discharge chute for controlling the direction of snow discharged from the apparatus. The impeller shroud, in conjunction with the drive gear housing provides for a smooth contoured surface which resists accumulation and build up of snow and ice which would clog the snow discharge flow path. The shroud includes wall surfaces providing an optimum discharge angle away from the operator, together with maximum throw distance for the snow and improved directional control to the snow discharge flow stream. A set of directional control vanes mounted on the shroud provides for still further control over the snow discharge flow direction.

In accordance with yet another aspect of the present invention the housing or shroud for the snow removal apparatus is provided with a removable combination skid and snow scraper bar which is made of substantially abrasion resistant material and engages the surface being cleaned in such a manner that it provides for scraping ice and snow from the surface and directs these substances into the path of the impeller paddles for ejection from the shroud with the main flow stream. The combination skid and scraper bar is easily replaced if need be.

Those skilled in the art of snow removal apparatus will appreciate that the present invention provides an apparatus which is easy to transport to and from the worksite and is particularly adapted for easy operation due to the lightweight power unit and the generally well balanced arrangement of the components of the apparatus. It will further be appreciated that the apparatus of the present invention may be easily maneuvered with minimal effort by the operator and is adapted to be disconnected from the prime mover so that the support boom and impeller section of the apparatus may be stored during the non-snow season while the power unit may be used with other attachments. It will be still further appreciated that the apparatus of the present invention is mechanically uncomplicated and reliable in operation. These and other superior features of the present invention will become further apparent to those skilled in the art upon reading the detailed description which follows in conjunction with the drawings.

DESCRIPTION OF THE PREFERRED EMBODIMENT

Figure 1:
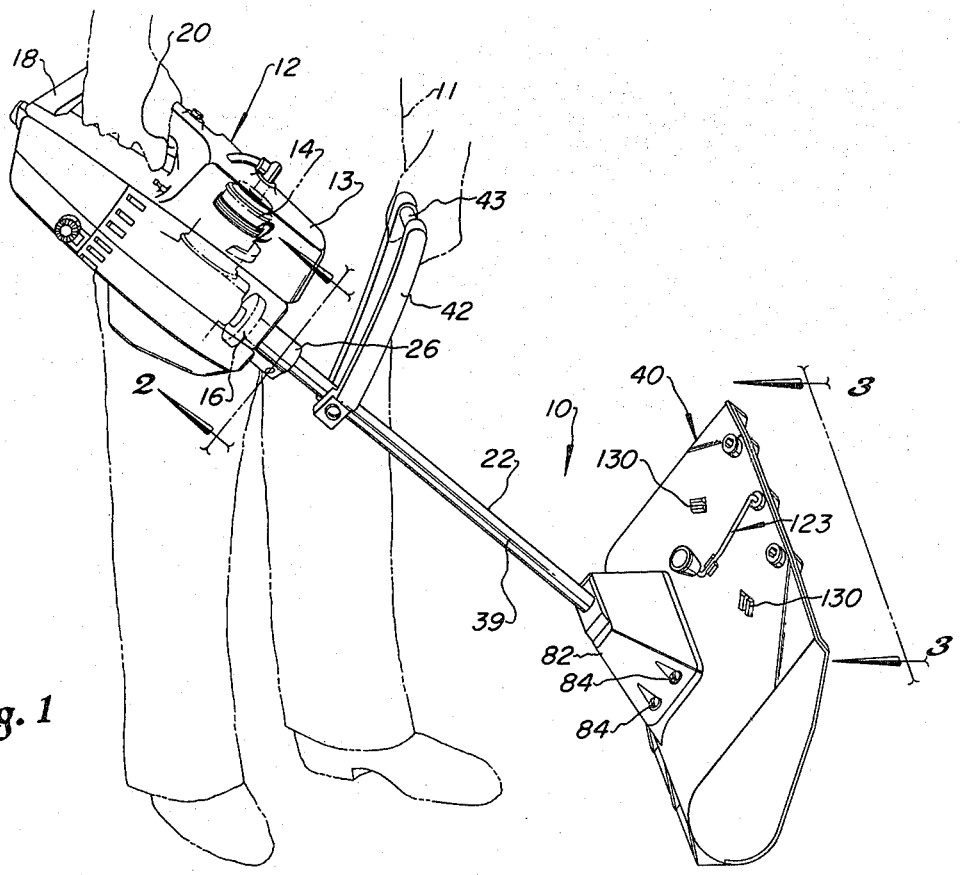
FIG. 1 is a perspective view of the snow removal apparatus of the present invention being held by an operator in the normal working position.

In the description which follows, like parts are marked throughout the specification and drawings with the same reference numerals, respectively.

The invention will be described in connection with a preferred embodiment of a portable powered snow removal apparatus illustrated in FIG. 1 and generally designated by the numeral 10. The apparatus 10 is characterized by a power unit, generally designated by the numeral 12, which includes a substantially self contained prime mover in the form of an internal combustion engine 14 having a power takeoff shaft adapted to be driveably engageable with a clutch unit 16. The power unit 12 includes a housing 13 having an integral handle 18 and a digitally actuatable throttle lever 20 for operating the engine 14 through its normal operating speed range. The power unit 12 is preferably of the type disclosed in U.S. patent application Ser. No. 051,950 filed June 25, 1979 now U.S. Pat. No. 4,286,675 and assigned to the assignee of the present invention.

Figure 2:
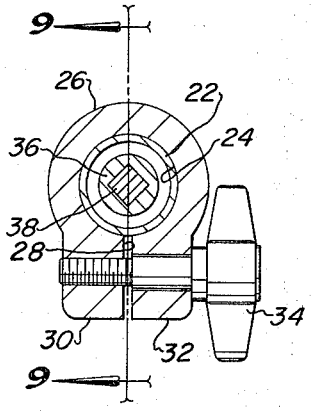
FIG. 2 is a detail transverse section view taken along the line 2—2 of FIG. 1 of the connection between the power unit and the tubular boom support of the apparatus.
Figure 9:
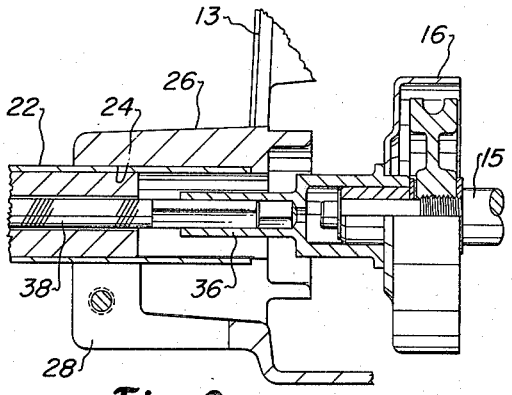
FIG. 9 is a detail section view taken along line 9—9 of FIG. 2 showing the drive coupling arrangement of the power unit.

Referring also to FIGS. 2 and 9 the power unit 12 is adapted to be removably connected to one end of a support comprising an elongated tubular boom 22 which is insertable in a bore 24 formed in a boss 26 integrally formed on the housing 13. The boss 26 includes a longitudinal slot 28 forming opposed lugs 30 and 32 which are adapted to be drawn toward each other by a manually tightened lock screw 34 to clamp the end of the boom 22 in the bore 24.

As shown also in FIG. 9 the centrifugal clutch 16 is drivenly engageable with engine shaft 15 and includes a power takeoff shaft portion 36 which is engaged with an elongated drive shaft 38. The drive shaft 38 may be arranged within the boom 22 in a manner similar to that disclosed in U.S. patent application Ser. No. 095,575 filed Nov. 19, 1979 and assigned to the assignee of the present invention.

Referring again to FIG. 1 the apparatus 10 is further characterized by a housing or shroud 40 preferably made of molded plastic or cast aluminum and mounted on the opposite end of the boom 22 from the power unit 12 in a manner to be described in further detail herein. The apparatus 10 also includes an adjustable handle 42 which, as shown in FIG. 1, includes a crossbar 43 which may be grasped by one hand of an operator 11 while the operator grasps the handle 18 of the power unit with the other hand. The handle 42 is suitably adjustably mounted on the boom 22. The handle 42 as well as the arrangement for mounting the handle on the boom 22 is preferably similar to that which is disclosed in the aforementioned U.S. patent application Ser. No. 051,950. The overall arrangement of the power unit 12 and the adjustable handle 42 provides for an improved hand carried power operated snow removal apparatus having superior weight distribution and balance to enhance the handling characteristics for removing snow and ice from substantially flat horizontal surfaces as well as irregular and sloping surfaces or elevated surfaces such as steps and porches.

Figure 3:
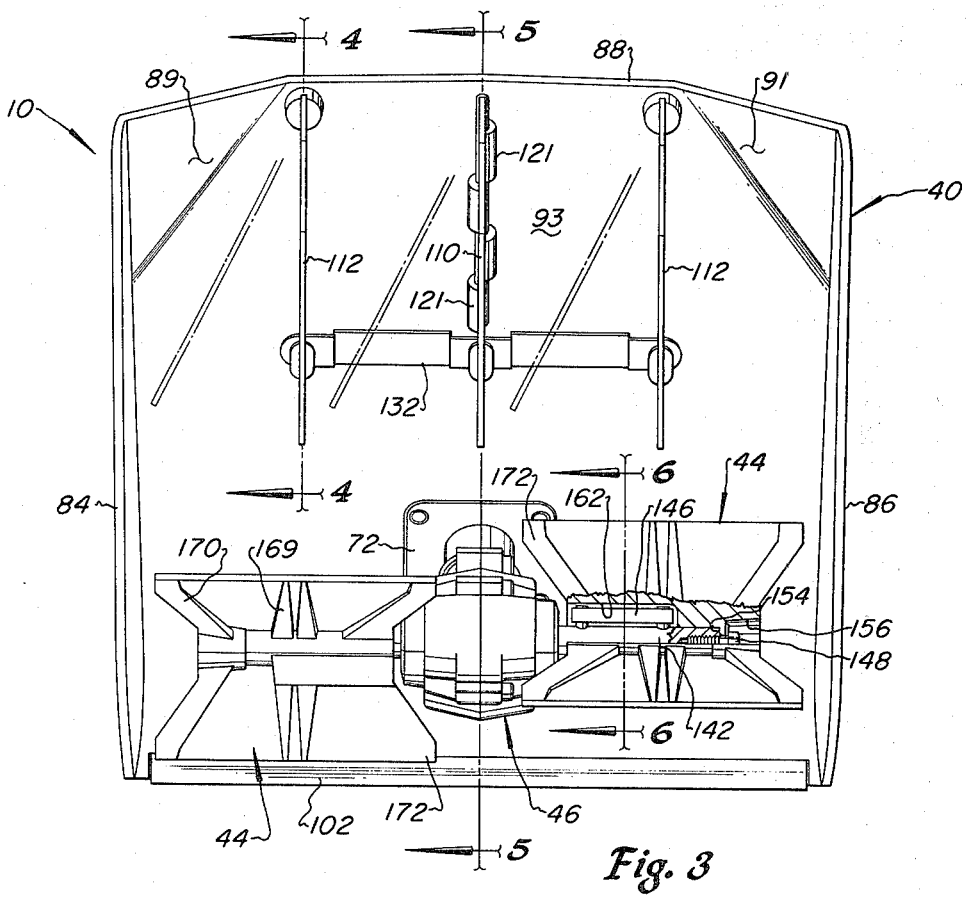
FIG. 3 is a vertical elevation view taken substantially from the line 3—3 of FIG. 1 showing the impellers and the interior of the snow discharge directional control shroud.
Figure 5:
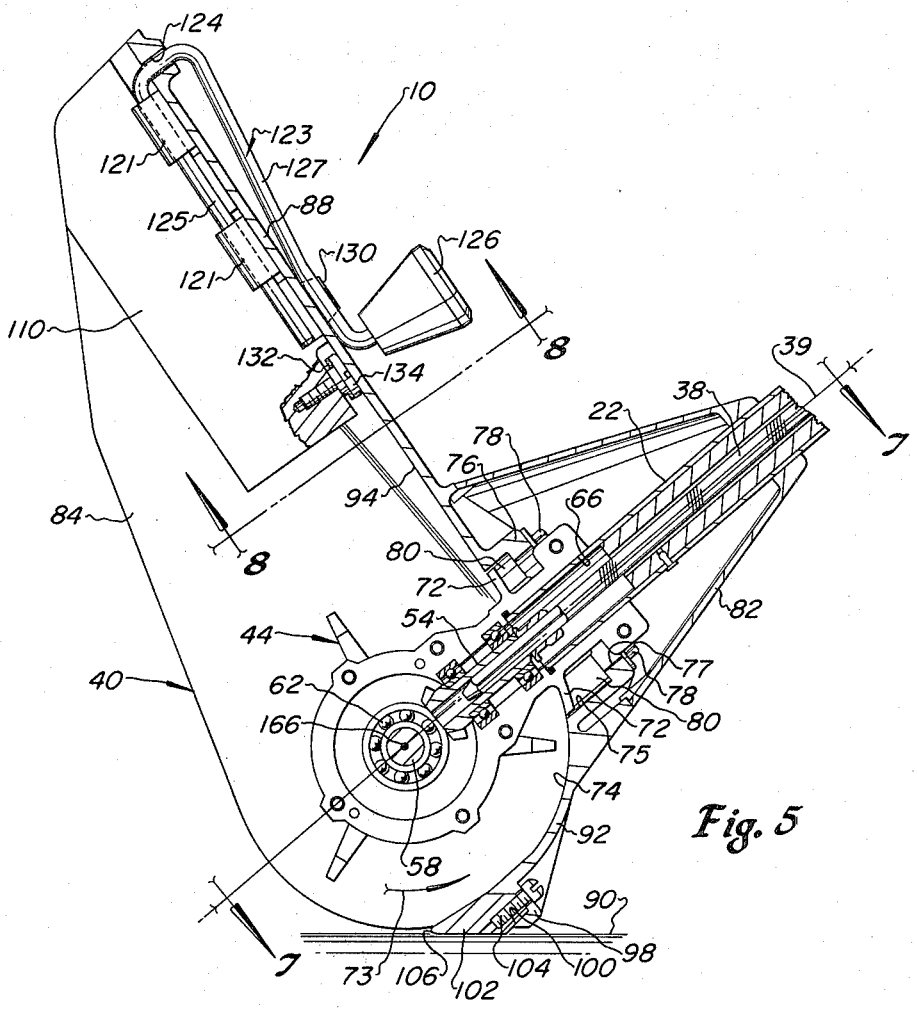
FIG. 5 is a section view taken substantially along the line 5—5 of FIG. 3.
Figure 7:
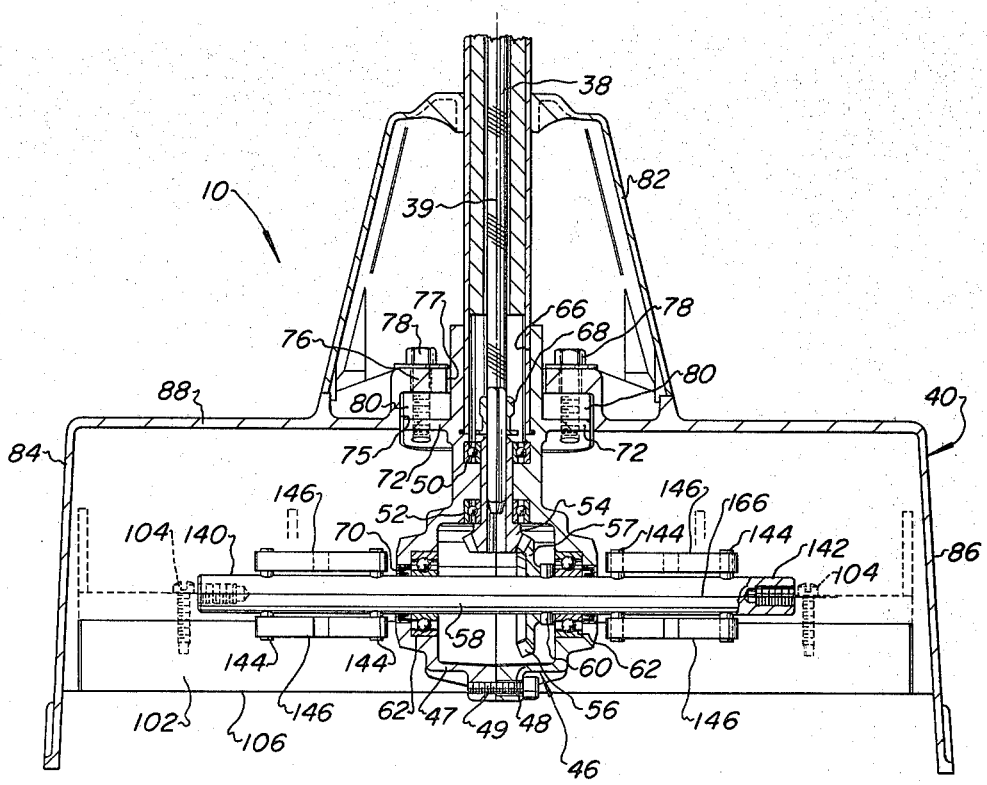
FIG. 7 is a section view of the drive mechanism and directional control shroud taken substantially along the line 7—7 of FIG. 5 with the impellers removed from the output shaft.

Referring now to FIGS. 3 and 5 the snow removal apparatus 10 includes drive mechanism mounted on the lower end of the boom 22 providing for a centered right angle drive for a pair of spaced apart snow impellers 44 disposed substantially within the shroud 40. Referring also to FIG. 7, the drive mechanism includes right angle drive gear means disposed within a housing 46 which may be formed by a pair of housing members 47 and 48 adapted to be joined together by a plurality of fasteners 49 along a plane coincident with the longitudinal axis of rotation 39 of the drive shaft 38 which coincides with the longitudinal centerline of the boom 22. The housing 46 includes suitable spaced apart bearings 50 and 52 which rotatably journal a bevel gear pinion 54. The pinion 54 includes a socket for receiving a drive tang on the end of the drive shaft 38. The pinion 54 is meshed with a driven gear 56 which is connected to an elongated output shaft 58 by means of a suitable driving connection including a pin 60. The pin 60 projects through the shaft 58 and is retained in driving engagement with a hub 57 of the gear 56. The shaft 58 projects in opposite directions from opposed sides of the housing 46 and is suitably rotatably mounted in the housing on spaced apart bearings 62. The shaft 58 may be advantageously fabricated to be of a single diameter throughout its length as illustrated thereby simplifying fabrication of the shaft and assembly or disassembly of the gear drive unit.

As shown also in FIGS. 5 and 7, the lower end of the boom 22 is disposed in a bore 66 formed by the mating housing members 47 and 48 and is suitably clamped to the housing 46 by forcible engagement with the members 47 and 48 when they are clamped together by fasteners 49. The bearing 50 may be of a commercially available type having suitable seals to prevent contamination of the bearing from material outside of the housing 46 and to prevent lubricant within the interior of the housing from leaking out through the bore 66. The shaft 38 is also provided with a seal member 68 which is disposed adjacent the hub portion of the gear 54. Suitable shaft seals 70 may also be provided in the housing members 47 and 48 to seal the interior of the housing with respect to the shaft 58 at the respective points where the shaft projects from opposite sides of the housing.

As further shown in FIGS. 5 and 7 the housing members 47 and 48 are provided with portions forming a flange, generally designated by the numeral 72, which is contoured to conform substantially to a curved inner wall surface portion 74 of the shroud 40. Accordingly, the flange 72 contributes to a smooth contoured surface which substantially eliminates any tendency for snow or ice to accumulate and clog the flow path along the interior surface of the shroud 40 in the vicinity of the impeller paddles 44.

Although the housing 46 is shown as being split longitudinally with respect to the axis 39 it will be appreciated by those skilled in the art that the housing could also be fabricated as substantially a one piece housing with a removable cover member on one side adjacent either one of the bearings 62 to provide for assembly and disassembly of the gears 54 and 56.

Referring still further to FIGS. 5 and 7, the shroud 40 includes a recess 75 formed in the wall surface portion 74 and delimited by a mounting flange 76 having a bore 77 through which projects the upper end of the housing 46. A plurality of threaded fasteners 78 are provided to fasten the shroud 40 to the housing 46 against suitable bosses 80 provided on the respective housing members 47 and 48 as shown. A removable, hollow cover member 82 is disposed around the boom 22 and encloses the mounting flange 76 on the housing 40. As shown in FIG. 1, the cover member 82 is removably fastened to the shroud 40 by suitable fasteners 84.

Referring to FIGS. 3, 5 and 7 the shroud 40 includes spaced apart lateral sidewalls 84 and 86 integrally formed with a rear wall 88 which, as shown also in FIG. 1, extends upwardly and forwardly away from the handles 18 and 42 and the operator of the apparatus 10. In a normal working position the upper portion of the rear wall 88 forms an angle of about 50 to 60 degrees with respect to a surface 90 which is to have snow removed therefrom. The rear wall 88 extends downwardly to a curved lower portion 92 forming the curved interior wall surface portion 74 which blends into a surface portion 94 for guiding a flow stream of snow and ice particles upwardly and away from the operator of the apparatus 10.

The lower end of the wall portion 92 includes a flange 98 extending transversely across the shroud 40 and including an elongated recess 100 in which is mounted a scraper bar 102 adapted to be removably secured to the shroud 40 by a plurality of threaded fasteners 104, one shown in FIG. 5. The scraper bar 102 is preferably made of a high strength abrasion resistent plastic or composite material and is adapted to be the member which engages the surface from which snow and ice is being removed. The scraper bar 102 includes a wedge shaped portion forming a leading edge 106 for engaging compacted snow or ice lying closely adjacent to the surface 90 as the apparatus 10 is pushed along the surface. The material is forced up along the contoured surface 74 and is engaged by the impellers 44, which are rotating in the direction indicated by the arrow 73 in FIG. 5, and entrained in the main flow stream of snow being impelled upwardly along the surfaces 74 and 94.

As will be appreciated from viewing FIGS. 3, 5 and 7 the shroud 40 forms a superior snow discharge chute which is provided with a substantially continuous smooth inner wall surface for guiding the discharge flow stream of snow being impelled by the impellers 44. The interior wall surfaces 74 and 94 together with the contoured flange 72 and the overall shape of the housing 46 substantially eliminates any tendency for snow and ice to collect and build up in areas which would reduce the ability of the impellers to gather and discharge snow. As shown in FIG. 3 the rear wall 88 includes opposed somewhat triangular shaped portions 89 and 91 which are bent away from the plane of the wall portion 93 to further deflect the flow stream of snow toward the center line of the apparatus 10 to enhance the directional control over the discharge flow.

Figure 4:
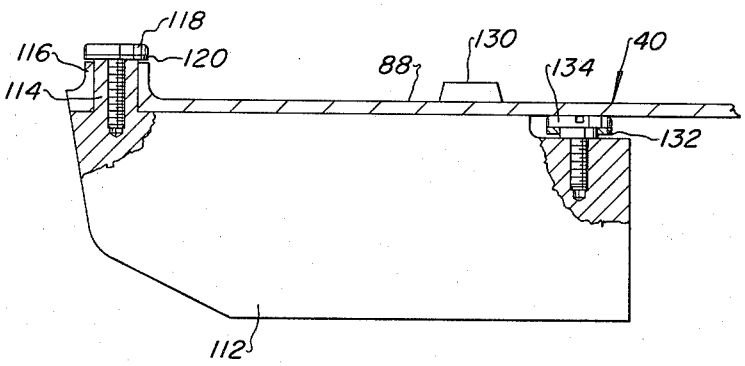
FIG. 4 is a detail section view taken substantially along the line 4—4 of FIG. 3.
Figure 8:
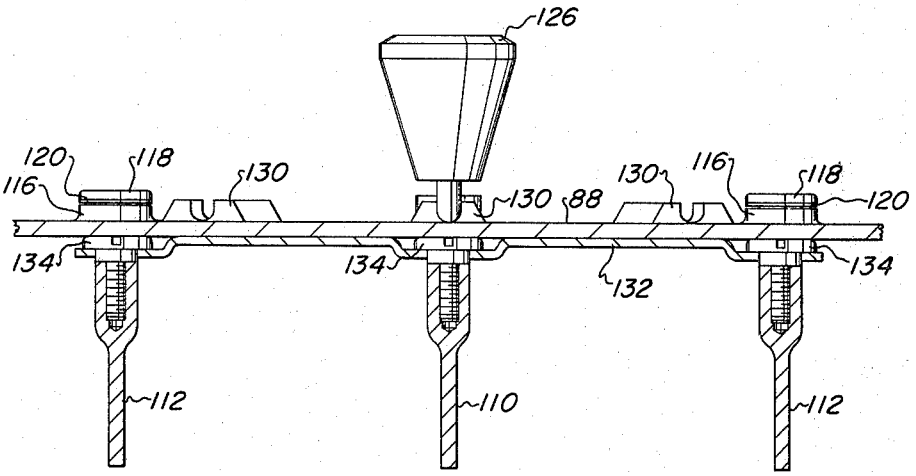
FIG. 8 is a section view taken substantially along the line 8—8 of FIG. 5 and illustrating the adjustable directional control vane mechanism.

Directional control of the snow being discharged by the apparatus 10 is further accomplished by a set of guide vanes shown in FIGS. 3, 4, 5 and 8. Referring to FIGS. 3, 4 and 8, a set of guide vanes comprising a center vane 110 and a pair of side vanes 112, mounted on opposite sides of the center vane 110, are pivotally mounted on the rear wall 88 and are adjustable to vary the directional attitude of snow being discharged from the shroud 40. As shown in FIG. 4, by way of example, the side vanes 112 are each provided with an integral trunnion 114 which is adapted to pivotally mount in a boss 116 projecting from the outer surface of the rear wall 88 of the shroud. The vane 112 is suitably retained for pivotal movement on the wall 88 by a threaded fastener 118 and a retaining washer 120, as shown in FIGS. 4 and 8. Referring to FIGS. 3 and 5, the center vane 110 includes a plurality of opposed integral bosses 121 for engaging an elongated rod-like substantially U-shaped lever 123 which projects through an opening 124 in the rear wall 88 and includes opposed leg portions 125 and 127. The leg 127 includes an end portion on which a knob 126 is mounted to facilitate movement of the lever to pivot the vanes 110 and 112 to change their directional attitude. As shown in FIGS. 1 and 8 the outer surface of the wall 88 includes a plurality of spaced apart projections forming detents 130 for engaging the lever 123 to hold the guide vanes in a center position and left and right angled positions for directing the discharge flow of snow from the shroud 40. One angular position is shown, by way of example, by the dashed lines in FIG. 3. By forming the legs 125 and 127 to have a built in spring bias to engage the wall 88 the vane assembly is held snugly against the inner wall surface 94 and the lever is suitably retained in the spaced apart detents 130. The lever 123 is moved out of the recesses formed in the respective detents 130 by lifting up on the knob 126 to overcome the aforementioned spring bias and pivoting the lever from one detent position to the next, as desired. The vanes 110 and 112 are interconnected at their respective ends opposite the ends about which they are pivoted on the shroud 40 by a link 132 interconnecting the vanes and retained thereon by suitable pan head shoulder screws 134 threadedly engaged with the vanes, as shown in FIG. 8. When the vane 110 is pivoted by the lever 123 the vanes 112 are maintained parallel to the vane 110 as well as each other in substantially all positions in which directional control of the snow discharge is desired. Accordingly, an improved arrangement of directional control guide vanes is provided in a portable lightweight apparatus in accordance with the present invention.

Figure 6:
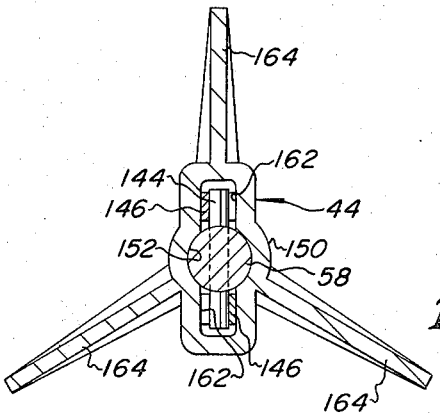
FIG. 6 is a section view taken substantially along the line 6—6 of FIG. 3.

In accordance with another important aspect of the present invention the impellers 44 are of a superior design and are respectively mounted on the opposed end portions of the shaft 58 by an improved drive key arrangement as shown in FIGS. 3, 6 and 7. Referring to FIG. 7, the opposite end portions 140 and 142 of the shaft 58 are each provided with improved drive key means comprising spaced apart cylindrical pins 144 projecting transversely through cooperable bores in the shaft 58. The pins 144 may be, for example, slotted tubular pins or spiral wrapped pins so that they are self holding in position in their respective shaft bores. The radially projecting portions of adjacent pins on opposite sides of the shaft 58 respectively support elongated spring steel band type keys 146, as shown in FIG. 7, in which view of the drawings the impellers 44 have been removed from the shaft for illustrative purposes. The keys 146 are formed with an elastic memory such that when they are slipped over the radially projecting ends of the pins 144 they suitably retain themselves in the positions shown. Referring also to FIG. 3 and FIG. 6, the impellers 44 are identical and are retained on the shaft ends 140 and 142 by suitable threaded fasteners 148, as shown by way of example in FIG. 3, which fasteners are threaded into tapped holes in the shaft ends. Each impeller 44 is characterized by a hub portion 150 having a bore 152 delimited at one end by an end wall 154 provided with a reduced diameter bore through which the fastener 148 projects. The fastener 148 is also disposed in a recess 156 formed in the end of the impeller.

Referring again to FIG. 6, the hub portion 150 of the impeller 44 includes opposed elongated recesses 162 comprising keyways in which the keys 146 are disposed for engagement with the longitudinal side walls of the recesses whereby the driving forces between the shaft 58 and the impeller are distributed substantially evenly along the length of the hub 150. Each impeller 44 is provided with three radially projecting paddle blades 164 which are equally spaced circumferentially with respect to the axis of rotation 166 of the shaft 58. The paddle blades 164 are provided with suitable reinforcing webs 169 and 170, as shown by way of example in FIG. 3.

Referring to FIG. 3, it will be noted that the radially outer most end portions 172 of the paddle blades 164 project longitudinally so as to overlie a major portion of the housing 46 thereby increasing the length of the swath or "bite" taken by the paddle blades and also to prevent an accumulation of packed snow around the housing 46 which would tend to reduce the flow area for discharge of snow by the impellers 44. The impeller paddle blades 164, in fact, have a somewhat trapezoidal shape to provide for a substantially uninterrupted sweep length of the apparatus which is delimited by the spaced apart side walls 84 and 86.

As will be noted from viewing FIG. 3, the impeller 44 mounted on the left side of the housing 46 and on the shaft end portion 140 is inverted with respect to the impeller mounted on the shaft portion 142. Since the impellers are provided with three equally spaced paddle blades the arrangement of one impeller being inverted with respect to the other provides for the blades of one impeller to be angularly offset with respect to the blades of the other impeller with respect to the axis of rotation 166. Therefor, while a blade 164 of one impeller is taking its maximum bite a blade of the other impeller is just entering the body of snow to be removed from the surface being plowed. The staggered relationship of the blades on the respective impellers provides for a more balanced and even distribution of the driving forces and reaction torque imposed on the drive mechanism and the power unit as well as reducing vibration and the tendency for the apparatus to stall when engaging particularly dense or compacted snow. Accordingly, the arrangement of the two three-bladed impellers improves the operability of the snow removal apparatus of the present invention. The arrangement of the impellers 44 also provides for using only one impeller part on both the left and right hand end portions of the shaft and eliminates the need for separate left and right hand impeller members.

In the operation of the apparatus 10, prior to starting the engine 14 the operator would normally adjust the position of the handle 42 to optimize the balance and handling characteristics of the apparatus to suit the particular operator for carrying as well as handling the apparatus during the operation thereof. In operation to remove snow from a surface, after starting the engine, the operator would control the speed of same by the digital throttle lever 20 while grasping the handle 18 with one hand and grasping the handle 42 with the other hand as shown in FIG. 1. With the convenient placement of the handles 18 and 42 the apparatus 10 may be handled in a manner similar to a conventional manual snow shovel. However, no particular exertion is required by the operator because as the shroud 40 is advanced into the snow with the skid 102 engaged with the surface to be cleaned the impellers 44 will rapidly bite into and accelerate the snow through a flow path generally formed by the surfaces 74 and 94 of the rear wall of the shroud 40. Accordingly, the apparatus 10 may be advanced through snow at a suitable rate determined by the speed of the engine 14 sufficient to allow the impellers 44 to displace all of the snow which they encounter. If a relatively large surface area is to be cleaned the operator may need to make several "sweeps" along the surface and direct the throw of snow discharge in a particular direction to avoid having to "shovel" snow more than one time. In this regard the directional control vanes 110 and 112 may be set to facilitate the directional attitude of the snow being discharged from the shroud 40 by moving the vanes from their centered position to one or the other of the angular settings. Alternatively, if the desired directional attitude of snow discharge from the intended path of the apparatus is not substantial the operator may elect to merely yaw the apparatus 10 slightly to one side of the direction of the path being cleared to direct the snow being discharged at an angle to one side or the other without substantially reducing the width of the path being cleared of snow.

Thanks to the substantially balanced weight distribution of the apparatus 10, as provided by having the power unit 12 disposed at one end of the support boom 38, together with the center drive mechanism provided by the gear drive contained within the housing 46 the apparatus is particularly easy to manipulate in confined areas. Moreover, the apparatus 10, being compact and of a lightweight and balanced design, may be easily maneuvered to "shovel" elevated surfaces such as steps, stairways, and porch surfaces. The apparatus 10 is also particularly advantageously used to remove snow from sloping surfaces such as driveways and sidewalks which are difficult or impossible to plow with wheel mounted apparatus, particularly if there is a glaze of ice or compacted snow on the surface which does not permit adequate traction of self propelled equipment.

The design of the shroud 40, including the substantially continuous smooth inner wall surface provided by the surfaces 74, 94 and the contoured flange 72, together with the general shape of the housing substantially eliminates any tendency for snow to accumulate and clog the interior of the shroud. The present invention also enjoys the advantages of the superior design of the impellers 44 and the superior drive key arrangement provided by the keys 146 and their associated pins 144 which distribute the driving forces over a relatively large area of the impeller hub.

If needed, the apparatus 10 may also be easily disassembled for service or replacement of certain components. The scraper bar 102, which is subject to severe abrasion in the use of the apparatus 10, may be easily replaced when worn by merely removing the fasteners 104 and replacing the bar with a new one. Moreover, the unit may be easily disassembled by removing the fasteners 84 securing the cover 82 in place and sliding the cover up the tubular boom 22 until access to the fasteners 78 is possible whereby the shroud 40 may be easily disconnected from the housing 46 and slid upward along the boom 22. The impellers 44 may then be easily removed from the respective ends of the shaft 58 upon removal of the retaining fasteners 148. The housing 46 may also be disassembled if necessary by removing the fasteners securing the respective housing members 47 and 48 in assembly.

As will be appreciated from the foregoing description a substantially superior portable hand held snow removal apparatus is provided which has reduced physical size and weight to enhance the handling characteristics thereof, and has a readily detachable power unit mounted at one end of an elongated boom type support whereby the power unit may be used in conjunction with other attachments. Furthermore, the apparatus 10 has a mechanically uncomplicated and reliable drive mechanism as well as improved paddle type impellers which reduce vibration and improve the torque load characteristics imposed on the prime mover. The directional control features provided by the shape of the housing 40 together with the guide vane mechanism of the instant invention also improves the operation of the apparatus 10.

It will further be appreciated by those skilled in the art that various embodiments of the invention may be derived without departing from the scope and spirit of the appended claims.

What is claimed is:

1. A portable power operated snow removal apparatus adapted to be hand carried and maneuvered for removing snow from a surface, said apparatus comprising:

an elongated support;

handle means on said apparatus for carrying and maneuvering said apparatus to remove snow from a surface;

a power unit including a prime mover and a power takeoff shaft, said power unit being mounted on one end of said support;

an elongated drive shaft rotatably supported by said support and interconnected between said power takeoff shaft and drive mechanism mounted at the opposite end of said support, said drive mechanism including a housing rotatably supporting an output shaft having opposed end portions projecting from said housing and rotatable about an axis substantially perpendicular to said support;

impeller means comprising separate snow impellers mounted on respective ones of said opposed end portions of said output shaft for removing snow from said surface, each of said impellers including a plurality of angularly spaced generally radially projecting paddle blades connected to a hub adapted for mounting said impeller on said output shaft;

means drivably interconnecting said output shaft with said impellers, respectively; and a shroud disposed at said one end of said support and partially enclosing said impellers, said shroud including a rear wall and spaced apart side walls extending forwardly from said rear wall in the direction of movement of said apparatus to engage a quantity of snow with said impellers, said shroud forming a discharge chute for directing snow removed from said surface by said impellers in a direction generally upward and away from said handle means.

2. The invention set forth in claim 1 wherein:

said handle means includes a first handle connected to said power unit and a second handle mounted on said support.

3. The invention set forth in claim 2 wherein:

said support comprises an elongated tubular boom.

4. The invention set forth in claim 3 wherein:

said apparatus includes a releasable coupling interconnecting said boom with said power unit.

5. The invention set forth in claim 4 wherein:

said coupling includes a boss formed on said power unit including a socket for receiving one end of said boom, and a threaded fastener adapted for clamping said boom in said socket.

6. The invention set forth in claim 1 wherein:

the blades of one of said impellers are angularly offset from the blades of the other of said impellers with respect to the axis of rotation of said output shaft.

7. The invention set forth in claim 1 wherein:

the blades of each of said impellers extend longitudinally at their radially outermost end portions to overlie said housing.

8. The invention set forth in claim 1 wherein:

said impellers are mounted on said output shaft substantially equidistant on opposite sides of a longitudinal center line of said support.

9. The invention set forth in claim 1 wherein:

said output shaft is substantially cylindrical and is of substantially one diameter throughout its length.

10. The invention set forth in claim 1 wherein:

said apparatus includes a skid member removable mounted on a lower portion of said rear wall of said shroud.

11. The invention set forth in claim 10 wherein:

said skid member includes a wedge shaped portion forming a scraper edge for scraping snow off of a surface from which snow is to be removed by said apparatus and toward an inner wall surface of said rear wall.

12. The invention set forth in claim 1 together with:

a set of spaced apart guide vanes mounted on an upper portion of said rear wall adjacent an inner wall surface, and means for varying the directional attitude of said vanes so as to vary the direction of snow discharged from said shroud.

13. The invention set forth in claim 12 wherein:

said vanes are pivotally mounted on said shroud, and said means for varying the directional attitude of said vanes includes means for maintaining said vanes substantially parallel to each other.

14. The invention set forth in claim 13 wherein:

said vanes are pivotally mounted on said rear wall adjacent the discharge end of said inner wall surface.

15. The invention set forth in claim 13 wherein:

said means for varying the directional attitude of said vanes includes a lever mounted on said rear wall of said shroud and connected to at least one of said vanes, and linkage means interconnecting said one vane with the other of said plurality of vanes.

16. The invention set forth in claim 15 wherein:

said lever includes a portion disposed adjacent a surface of said rear wall opposite said inner wall surface and engageable with detent means on said shroud for holding said vanes in one of a plurality of directional attitudes.

17. A portable powered snow removal apparatus comprising:

an elongated support;

first and second handles spaced apart on said support and adapted for carrying and maneuvering said apparatus to remove snow from a surface;

a prime mover connected to said support;

a shroud supported by said support including a rear wall portion extending upward in the normal working position of said apparatus and forming a discharge chute for snow removed from said surface by said apparatus;

a drive mechanism including a housing enclosing drive means substantially centrally disposed with respect to the sides of said rear wall and in front of said rear wall and supported by said support, said drive mechanism including a rotatable output shaft extending from opposite sides of said housing for rotation about an axis substantially perpendicular to said support, said output shaft supporting snow impeller means disposed on opposite sides of said housing and drivably connected to said prime mover, said impeller means comprising a plurality of generally radially projecting angularly spaced blades for engaging snow on a surface and impelling said snow upward along said rear wall of said shroud for discharge in a direction generally away from said handle means.

18. The invention set forth in claim 17 wherein:

said shroud includes a spaced apart side wall joined to said rear wall, said rear wall including an inner wall surface delimited by upper and lower edges of said rear wall, and means mounted on said shroud and operable to vary the directional attitude of snow discharged from said shroud.

19. The invention set forth in claim 18 wherein:

said means for varying the directional attitude of snow discharged from said shroud includes movable guide vane means mounted on said shroud adjacent said inner wall surface.

20. The invention set forth in claim 19 wherein:

said movable guide vanes comprise a plurality of spaced apart vane members mounted on said rear wall, and linkage means interconnecting said vane members for moving said vane members in unison to form a plurality of discharge flow channels.

21. The invention set forth in claim 20 together with:

a lever mounted on said shroud and connected to said vane members for moving said vanes from one position to another.

22. The invention set forth in claim 21 wherein:

said lever includes a handle portion disposed adjacent the exterior surface of said rear wall.

23. The invention set forth in claim 22 wherein:

said rear wall portion includes detent means for retaining said lever in a selected one of a plurality of angular positions of said guide vanes.

24. The invention set forth in claim 21 wherein:

said plurality of vane members includes a center vane connected to said lever and a pair of side vanes spaced apart on opposite sides of said center vane, said vane members being pivotally mounted on said shroud adjacent said upper edge.

25. The invention set forth in claim 17 together with:

a removable skid mounted on said shroud for engagement with a surface from which snow is to be removed.

26. A portable power operated snow removal apparatus comprising:

an elongated support;

handle means on said apparatus for maneuvering said apparatus to remove snow from a surface;

a power unit including a prime mover and a power takeoff shaft, said power unit being mounted on one end of said support;

drive mechanism mounted at the opposite end of said support, said drive mechanism including a housing rotatably supporting an output shaft having opposed end portions projecting from said housing;

snow impeller means connected to said output shaft in driven engagement therewith; and an elongated drive shaft mounted on said support and drivably interconnecting said power takeoff shaft with a pinion rotatably mounted in said housing, said pinion being drivably meshed with a gear mounted on said output shaft.

27. The invention set forth in claim 26 wherein:

said housing is substantially centrally mounted on said support with respect to the longitudinal central axis of said drive shaft.

28. The invention set forth in claim 26 wherein:

said support comprises an elongated tubular boom, said drive shaft is mounted within said boom, and said housing includes a socket portion for receiving the end of said boom opposite said one end.

29. An impeller for a powered snow removal apparatus comprising:

a hub portion including a longitudinal bore adapted for mounting said impeller on a shaft, said hub portion including two diametrally opposed and substantially parallel longitudinal keyways opening into said bore; and a plurality of generally radially projecting blades integrally formed with said hub portion and spaced apart circumferentially with respect to the axis of rotation of said impeller, said blades each comprising a substantially cantilever beam.

30. The invention set forth in claim 29 wherein:

said impeller includes three blades equally spaced about said hub portion.

31. The invention set forth in claim 29 wherein:

the length of at least one of said blade at a radially outward portion with respect to said hub portion is greater than the length of said one blade at a point radially inward of said portion.

32. A power operated snow removal apparatus comprising:

a support;

a center drive gear housing mounted on said support including an output shaft having opposed end portions projecting from opposite sides of said housing;

motor means drivably connected to said output shaft; and snow impeller means connected to each of said end portions, said snow impeller means including a plurality of radially extending circumferentially spaced blades, said blades including portions extending longitudinally with respect to the axis of rotation of said output shaft to overlie opposed portions of said housing to minimize the accumulation of packed snow around said housing and increase the swath of said impeller means.

33. A power operated snow removal apparatus comprising:

an elongated support;

a center drive gear housing mounted at one end of said support;

an output shaft rotatably supported in said housing and having opposed end portions projecting from opposed sides of said housing;

snow impeller means connected to each of said end portions;

motor means drivably connected to said impeller means; and a dirve shaft disposed on said support and drivably interconnecting said motor means with said output shaft;

said housing comprising a pair of housing members adapted to be joined together along a plane coincident with the axis of rotation of said drive shaft.

34. A portable power operated snow removal apparatus comprising:

an elongated support;

a power unit including a prime mover and a power takeoff shaft, said power unit being mounted on one end of said support;

handle means on said apparatus for maneuvering said apparatus to remove snow from a surface;

drive mechanism mounted at the opposite end of said support, said drive mechanism including a housing rotatably supporting an output shaft having opposed end portions projecting from said housing and means drivably interconnecting said output shaft with said power takeoff shaft; and separate snow impellers mounted on respective ones of said opposed end portions of said output shaft, each of said impellers comprising a plurality of generally radially projecting paddle blades connected to a hub portion, a bore in said hub portion adapted for mounting said impeller on said output shaft, a recess in said hub portion, and said output shaft includes drive key means mounted on said output shaft and projecting into said recess, said key means comprising a pair of spaced apart radially projecting drive pins mounted on said output shaft, and a force distributing band interconnecting said pins and disposed in said recess in driving engagement with said impeller.

35. The invention set forth in claim 34 wherein:

said impeller includes opposed recesses in said hub portion and said output shaft includes bands mounted on said spaced apart pins on diametrally opposed sides of said output shaft end portion and disposed in respective ones of said opposed recesses in said hub portion.

36. A portable power operated snow removal apparatus comprising:

an elongated support;

handle means on said apparatus for maneuvering said apparatus to remove snow from a surface;

a power unit including a prime mover and a power takeoff shaft, said power unit being mounted on one end of said support;

drive mechanism mounted at the opposite end of said support, said drive mechanism including a housing rotatably supporting an output shaft having opposed end portions projecting from said housing;

means drivably interconnecting said power takeoff shaft with said output shaft;

separate snow impellers mounted on respective ones of said opposed end portions of said output shaft, each of said impellers comprising a plurality of generally radially projecting paddle blades connected to a hub, said blades extending longitudinally at their radially outermost end portions to overlie said housing, and a bore in said hub adapted for mounting said impeller on said output shaft; and means drivably interconnecting said output shaft with said impellers.

37. A portable power operated snow removal apparatus comprising:

an elongated support;

handle means on said apparatus for maneuvering said apparatus to remove snow from a surface;

a power unit including a prime mover and a power takeoff shaft, said power unit being mounted on one end of said support;

snow impeller means mounted at the opposite end of said support;

means drivably interconnecting said impeller means with said power takeoff shaft including drive mechanism mounted at the opposite end of said support, said drive mechanism including a housing rotatably supporting an output shaft, said impeller means being connected to said output shaft in driven engagement therewith;

a shroud at least partially enclosing said impeller means and forming a discharge chute for directing snow generally upward and away from said power unit, said should including a rear wall including upper and lower portions forming a substantially continuous smooth inner wall surface for guiding a flow stream of snow impelled by said impeller means, a recess in said rear wall and a flange delimiting said recess and adapted for removably mounting said shroud on said housing, and said housing includes a flange adapted to form a contoured closure over said recess to provide a substantially uninterrupted wall surface in the vicinity of said recess.

38. A powered snow removal apparatus comprising:

a support member;

a power unit connected to said support member and drivably connected to a drive shaft;

a gear housing supported on said support member;

gear means disposed in said housing and drivably connected to said drive shaft;

an output shaft rotatably mounted in said housing and drivably connected to said gear means, said output shaft comprising a one piece shaft of substantially one diameter and extending through said housing so that its end portions project from opposite sides of said housing, a gear slidably mounted on and secured to said output shaft by a removable drive pin, said output shaft being supported in said housing by spaced apart bearings disposed on opposite sides of said gear in said housing; and snow impeller means drivably connected to respective ones of said oppositely projecting end portions of said output shaft.

* * * * *